US011912375B1

(12) United States Patent
Padron

(10) Patent No.: US 11,912,375 B1
(45) Date of Patent: Feb. 27, 2024

(54) SUSPENDED COOLER FRAME ASSEMBLY FOR SEA VESSELS

(71) Applicant: Jorge Padron, Miami, FL (US)

(72) Inventor: Jorge Padron, Miami, FL (US)

( * ) Notice: Subject to any disclaimer, the term of this patent is extended or adjusted under 35 U.S.C. 154(b) by 443 days.

(21) Appl. No.: 17/322,984

(22) Filed: May 18, 2021

(51) Int. Cl.
*B63B 25/28* (2006.01)
*B63B 17/00* (2006.01)
*B63B 29/04* (2006.01)

(52) U.S. Cl.
CPC ..... *B63B 25/28* (2013.01); *B63B 17/00* (2013.01); *B63B 29/04* (2013.01); *B63B 2025/285* (2013.01)

(58) Field of Classification Search
CPC ..... B63B 25/00; B63B 25/28; B63B 17/00; B63B 29/00; B63B 29/04
USPC ..... 114/364
See application file for complete search history.

(56) References Cited

U.S. PATENT DOCUMENTS 2,966,002 A 12/1960 Hobson et al.
4,279,365 A 7/1981 Hutmacher
4,861,301 A 8/1989 Pomeroy
6,035,800 A 3/2000 Clifford
6,834,609 B2 12/2004 Cannon, Jr.
6,866,001 B1 * 3/2005 Cuccia ..... B63B 32/83 114/364
7,802,709 B1 9/2010 Lewis et al.
8,371,548 B1 2/2013 Bishop
8,960,477 B1 * 2/2015 Bishop ..... B63B 17/00 224/579
11,541,969 B1 * 1/2023 Marasco ..... B63B 29/04
2004/0089218 A1 5/2004 Cannon, Jr.
2007/0095998 A1 5/2007 Gray
2008/0230501 A1 9/2008 Gray

FOREIGN PATENT DOCUMENTS

CA 2279804 A1 2/2001

* cited by examiner

*Primary Examiner* — Lars A Olson
(74) *Attorney, Agent, or Firm* — ALBERT BORDAS P.A.

(57) ABSTRACT

A suspended cooler frame assembly for sea vessels, having first and second suspending frame assemblies with respective first and second suspending arms; first and second vertical frame assemblies having respective first and second vertical bars attached to the first and second suspending arms respectively; first and second spacer frame assemblies perpendicularly mounted onto the first and second vertical frame assemblies respectively; first and second telescopic bar assemblies attached to the first and second vertical frame assemblies; and first and second supporting bar assemblies having respective first and second supporting bars attached to the first and second vertical frame assemblies respectively, whereby the first and second suspending frame assemblies are suspended from a gunwale of a sea vessel.

17 Claims, 3 Drawing Sheets

SUSPENDED COOLER FRAME ASSEMBLY FOR SEA VESSELS

BACKGROUND OF THE INVENTION

1. Field of the Invention

The present invention relates to boating accessories, and more particularly, to suspended cooler frame assemblies for sea vessels.

2. Description of the Related Art

Applicant believes that one of the closest references corresponds to U.S. Patent Application Publication No. 2008/0230501 A1, published on Sep. 25, 2008 to David R. Gray for a cooler support shelf. However, it differs from the present invention because Gray teaches a cooler support shelf that is a rectangular platform having each of two corner sections of one side of the platform perpendicularly connected to separate vertical rails. The tops of the two rails are curved into hooks in the direction away from the platform. Diagonal support struts are connected from opposed sides of the platform to the lower part of each vertical rail. A horizontal support bar may extend between the connections of the diagonal support struts and the vertical rails. A hook and loop restraining strap is connected near the top of each vertical rail. The two straps can connect around the cooler to keep it in place on the platform.

Applicant believes that another reference corresponds to U.S. Patent Application Publication No. 2007/0095998 A1, published on May 3, 2007 to David R. Gray for a cooler support shelf. However, it differs from the present invention because Gray teaches a cooler support shelf that is a rectangular platform having each of two corner sections of one side of the platform perpendicularly connected to separate vertical rails. The tops of the two rails are curved into hooks in the direction away from the platform. Diagonal support struts are connected from opposed sides of the platform to the lower part of each vertical rail. A hook and loop restraining strap is connected near the top of each vertical rail. The two straps can connect around the cooler to keep it in place on the platform.

Applicant believes that another reference corresponds to U.S. Patent Application Publication No. 2004/0089218 A1 published on May 13, 2004 to Ray Allen Cannon, Jr. for a boat rack. However, it differs from the present invention because Cannon, Jr. teaches a pivotally mounted rack removably attached to the hull of a boat by suitable means and adapted to be rotated to various positions inside and outside the boat hull as desired.

Applicant believes that another reference corresponds to U.S. Pat. No. 8,371,548 B1 issued to Jerry W. Bishop on Feb. 12, 2013 for a holder attachable to a boat. However, it differs from the present invention because Bishop teaches a holding device attachable to a rail, cleat, etc., of a boat or other object such that the holding device holds a cooler or similar objects without using up passenger space. The holding device is a generally rectangular shaped basket member that has a top rail and a first series of straps extending between opposing sides of the rail and a second series of straps extending between opposing ends of the rail, the first straps and the second straps crossing generally normal to one another. One or more straps secure the basket member to an appropriate point on the boat. One or more bumpers buffer the device against the side of the boat. The basket member may have a netting therein to hold small objects safely.

Applicant believes that another reference corresponds to U.S. Pat. No. 7,802,709 B1 issued to Jeffrey Thomas Lewis, et al. on Sep. 28, 2010 for a universal hanger cargo carrier for a boat trailer. However, it differs from the present invention because Lewis teaches a universal, adaptable hanger mounted cargo carrier for removable mounting over and around a trailer frame without requiring modification of either I-beam or box beam trailer rails. The carrier comprises a generally rectangular box with steel mesh floor and opposed inverted corner J-hook mounts for slidable mounting of the carrier over the trailer frame rail extending deep enough below the bottom of the rail to enable a locking mechanism to at least partially close the opening of the inverted J-hook below the frame. Inverted "U" shaped spacers reduce the size of the J-hook opening, thereby adapting the carrier for flush mounting on a range of different sized rails. A steel mesh floor and holes in the walls of the carrier for insertion of hook ends of bungee cords allow for retention and transport of objects of varying size and shape.

Applicant believes that another reference corresponds to U.S. Pat. No. 6,834,609 B2 issued to Ray Allen Cannon, Jr. on Dec. 28, 2004 for a boat rack. However, it differs from the present invention because Cannon, Jr. teaches a pivotally mounted rack removably attached to the hull of a boat and adapted to be rotated to various positions inside and outside the boat hull as desired.

Applicant believes that another reference corresponds to U.S. Pat. No. 6,035,800 A issued to Peter A. Clifford on Mar. 14, 2000 for a gunwale attachable dry box for small watercraft. However, it differs from the present invention because Clifford teaches a dry storage box held by a clamping device at a longitudinal location along the length of the small watercraft. Dry box provides watertight storage compartment with a hinged lid and latches for storing miscellaneous personal valuables and belongings. The clamped water tight box, in the event of capsize, remains secured to the gunwale, and thus valuables and belongings remain safe, dry and in one location. Incidentally provided are added buoyancy to the vessel in the event of a capsized condition, and when box is in normal use the longitudinal location allows free movement of the occupants about the small watercraft.

Applicant believes that another reference corresponds to U.S. Pat. No. 4,861,301 A issued to Jimmy R. Pomeroy on Aug. 29, 1989 for a personal flotation system. However, it differs from the present invention because Pomeroy teaches a haversack adapted to securely hold an ice chest and having a strap means to releasably attach the haversack to a toroid flotation device, e.g., an automobile inner tube, preferably on the exterior of the tube.

Applicant believes that another reference corresponds to U.S. Pat. No. 4,279,365 A issued to Joan K. Hutmacher on Jul. 21, 1981 for a fishing float container. However, it differs from the present invention because Hutmacher teaches a fishing float container that has a horizontal substantially flat base with slightly obtusely oriented curved, reverse tapered leg members disposed upwardly from the forward corners thereof, and a substantially rectangular backing disposed slightly obtusely and upwardly from the rear edge thereof, the backing having apertures for pivotal securement to a hanger member, the hanger being pivotal upward to hook over the side of a boat, and pivotal downward to a locking position wherein fishing floats are secured within the container.

Applicant believes that another reference corresponds to U.S. Pat. No. 2,966,002 A issued to C. D. Hobson, et al. on Dec. 27, 1960 for a live bait tank. However, it differs from the present invention because Hobson teaches a live bait tank for use with a boat, comprising a tank on said boat holding live bait and water, said tank being formed with ports; a scoop extending from the lower portion of said tank; and tube means extending from said scoop through the interior of said tank and then outwardly of said tank, a portion of said tube means within said tank being curved, with the inner peripheral section of said curved portion being formed with a plurality of discharge apertures, with forward movement of said boat effecting upward circulation of fresh water through said tube means, the greater the forward speed of said boat the higher the velocity at which said fresh water circulates through said tube, said fresh water flowing through substantially all of said discharge apertures at lower boat speeds with said fresh water flowing solely through the lower of said discharge apertures as its velocity increases because of the centrifugal force of said fresh water, whereby a substantially constant volume of fresh water is introduced into said tank regardless of the velocity at which said boat is moving forwardly.

Applicant believes that another reference corresponds to Canadian Patent No. CA 2,279,804 A1 issued to Rheult Alain et al. on Feb. 9, 2001 for a deck boat. However, it differs from the present invention because Alain et al teaches a watercraft that is equipped with a power train sufficient to move the watercraft at a substantial speed through the water and the seating layout on the deck provides the amenities of an extremely comfortable watercraft capable of seating over ten passengers while providing sufficient storage space for all necessary items for such a voyage. The watercraft is equipped with a substantially level deck area with an upper bow deck and a lowered pool area which when filled with water provides refreshment for the travelers. The watercraft is equipped with a compressible toilet compartment, a kitchen area and a double driver seat, which can be rotated from a party position to a driving position. A rear sundeck can be converted into upright seats. The bow and stern areas are equipped with retractable ladders. There is a fishing rod compartment and a water ski compartment. Under the kitchen area an ice chest or some other item can be stowed and movement throughout the watercraft is eased without clutter of items.

Other patents describing the closest subject matter provide for a number of more or less complicated features that fail to solve the problem in an efficient and economical way. None of these patents suggest the novel features of the present invention.

SUMMARY OF THE INVENTION

The present invention is a suspended cooler frame assembly for sea vessels, comprising first and second suspending frame assemblies having respective first and second suspending arms; first and second vertical frame assemblies having respective first and second vertical bars attached to the first and second suspending arms respectively; first and second spacer frame assemblies perpendicularly mounted onto the first and second vertical frame assemblies respectively; first and second telescopic bar assemblies attached to the first and second vertical frame assemblies; and first and second supporting bar assemblies having respective first and second supporting bars attached to the first and second vertical frame assemblies respectively, whereby the first and second suspending frame assemblies are suspended from a gunwale of a sea vessel.

The first and second suspending arms each comprise an interior end and an exterior end, wherein the interior ends are positioned within an interior perimeter of the sea vessel when mounted on the gunwale. The first and second suspending arms comprise a substantially curved section formed between respective exterior ends and the interior ends with a predetermined degree of curvature. The degree of curvature is in between 120 and 175 degrees.

The first and second vertical bars each comprise bar ends and a plurality of holes. The first and second vertical bars are attached to the first and second exterior ends. The first and second spacer frame assemblies each comprise a T-sleeve, an adjustable member, a spacer cap, spacer holes, and a push button, wherein each T-sleeve is mounted on a respective of the first and second vertical bars at a predetermined distance from the bar ends. Each T-sleeve and each adjustable member are configured for adjustment in a substantially perpendicular direction relative to the first and second vertical frame assemblies respectively.

The first and second telescopic bar assemblies each comprise an exterior bar having a respective exterior bar end, and an interior bar having a respective interior bar end. The first and second telescopic bar assemblies each comprise a plurality of adjusting holes, coupling members having respective locks, and locking buttons. The first and second telescopic bar assemblies are adjustably positioned between the first and second vertical bars and coupled thereto with respective the coupling members. The first and second telescopic bar assemblies are positioned substantially parallel to each other, and substantially perpendicular to the first and second vertical bars.

Each of the pair of hinge arms comprises a fastener pin and a lock pin. The pair of hinge arms extends from a respective supporting bar and is secured at their respective vertical bar with a respective the fastener pin and the lock pin. The plurality of holes, of each the vertical bar, receives a respective fastener pin to secure a respective supporting bar at a desired height.

The supporting bars are positioned and secured perpendicularly to respective vertical bars. The first and second supporting bar assemblies each further comprises an extension bar, and a plurality of bar holes. The first and second supporting bar assemblies are placed in a retracted configuration, whereby the first and second supporting bars are retracted toward the first and second vertical bars respectively. The first and second supporting bar assemblies in an extended configuration are in a same plane arranged to support a cooler. The first and second supporting bar assemblies are constructed and arranged to support the cooler, wherein the cooler is positioned onto the first and second supporting bars. The first and second supporting bar assemblies each comprise a strap to secure the cooler onto respective the first and second supporting bars.

It is therefore one of the main objects of the present invention to provide a suspended cooler frame assembly for sea vessels.

It is another object of this invention to provide a suspended cooler frame assembly for sea vessels that can be suspended to the gunwale outside a sea vessel.

It is another object of this invention to provide a suspended cooler frame assembly for sea vessels that is adjustable.

It is another object of this invention to provide a suspended cooler frame assembly for sea vessels that has a supporting bar assembly.

It is another object of this invention to provide a suspended cooler frame assembly for sea vessels that is volumetrically efficient for carrying, transporting, and storage.

It is another object of this invention to provide a suspended cooler frame assembly for sea vessels that can be readily assembled and disassembled without the need of any special tools.

It is another object of this invention to provide a suspended cooler frame assembly for sea vessels, which is of a durable and reliable construction.

It is yet another object of this invention to provide such an assembly that is inexpensive to manufacture and maintain while retaining its effectiveness.

In one embodiment, the curved region is constructed and arranged to position over a sea vessel gunwale.

In one embodiment, the suspending frame is configured as a rigid living spring for tension attachment above the gunwale.

In one embodiment, the suspending frame is constructed and arranged with the second end positioned within an interior perimeter of the sea vessel.

In one embodiment, the vertical frame assembly is arranged relative to a vertical side of the sea vessel.

In one embodiment, the supporting bar assembly is constructed and arranged to support a cooler.

In one embodiment, the spacer frame assembly includes an adjustable member configured for adjustment in a substantially perpendicular direction relative to the vertical frame assembly.

In one embodiment, the spacer frame assembly includes an adjustable member configured for selectively locking into a fixed position and unlocking as desired.

In one embodiment, the spacer frame assembly includes an adjustable member configured for selectively locking into a fixed position and unlocking as desired utilizing a ball detent locking mechanism.

In one embodiment, the supporting bar assembly includes straps configured with a first end secured to the supporting bar assembly and a second end for securing an article to the assembly.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figures 1, 1A:
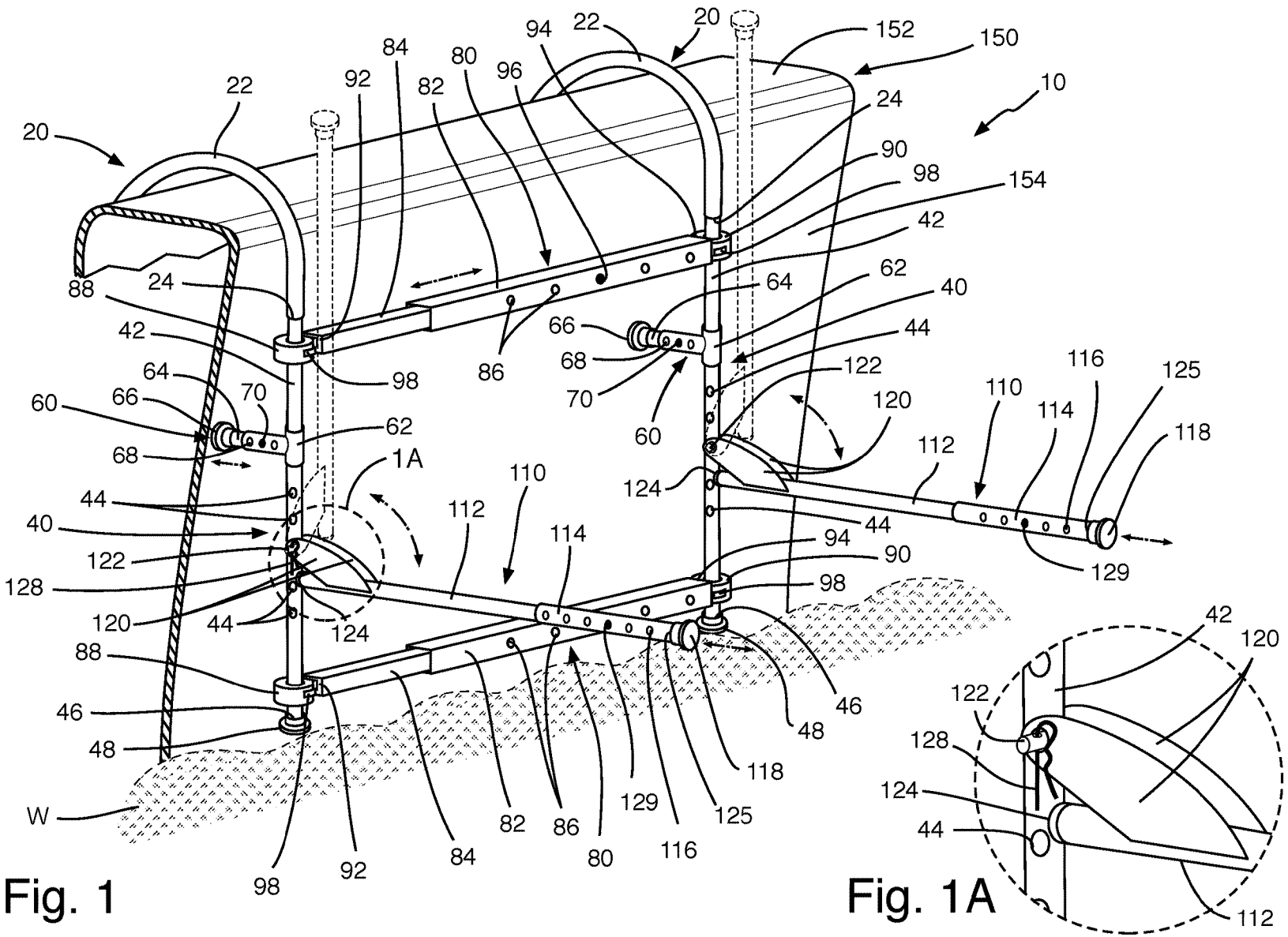
FIG. 1 is an isometric view of a suspended cooler frame assembly for sea vessels, mounted onto a gunwale of a vessel that is partially represented.
FIG. 1A is an enlarged view of section 1A from FIG. 1.

Referring now to the drawings, the present invention is a suspended cooler frame assembly for sea vessels, and is generally referred to with numeral 10. It can be observed that it basically includes suspending frame assemblies 20, vertical frame assemblies 40, spacer frame assemblies 60, telescopic bar assemblies 80, and supporting bar assemblies 110.

As seen in FIG. 1, present invention 10 is mounted onto sea vessel 150 that is partially represented. Sea vessel 150 comprises gunwale 152 and exterior surface 154. Sea vessel 150 may be, but is not limited to, being a boat, motorboat, yacht, fishing boat, sailboat, houseboat, or any watercraft.

In a preferred embodiment, first and second suspending frame assemblies 20 have respective first and second suspending arms 22. First and second vertical frame assemblies 40 have respective first and second vertical bars 42 that attach to respective first and second suspending arms 22. First and second suspending frame assemblies 20 are suspended from gunwale 152 of sea vessel 150. Each spacer frame assembly 60 is secured substantially perpendicular to its respective vertical frame assembly 40.

First and second telescopic bar assemblies 80 are both attached to vertical frame assemblies 40, whereby first and second telescopic bar assemblies 80 are adjustably positioned between first and second vertical bars 42 and coupled thereto with respective coupling members 88 and 90. First and second telescopic bar assemblies 80 are positioned substantially parallel to each other, and substantially perpendicular to vertical bars 42.

First and second supporting bar assemblies 110 have first and second supporting bars 112. First and second supporting bars 112 attach to respective first and second vertical frame assemblies 40, but opposite in direction to spacer frame assemblies 60.

As seen in FIGS. 1 and 1A, supporting bar assemblies 110 each further comprise a pair of hinge arms 120. Each pair of hinge arms 120 comprises fastener pin 122 and lock pin 128. Each pair of hinge arms 120 extends from a respective supporting bar 112 and is secured at their respective vertical bar 42 with a respective fastener pin 122 and lock pin 128. One of holes 44, of each vertical bar 42, receives a respective fastener pin 122 to secure supporting bar 112 at a desired height. In a preferred embodiment, supporting bar 112 is positioned and secured perpendicularly to vertical bar 42.

Figure 2:
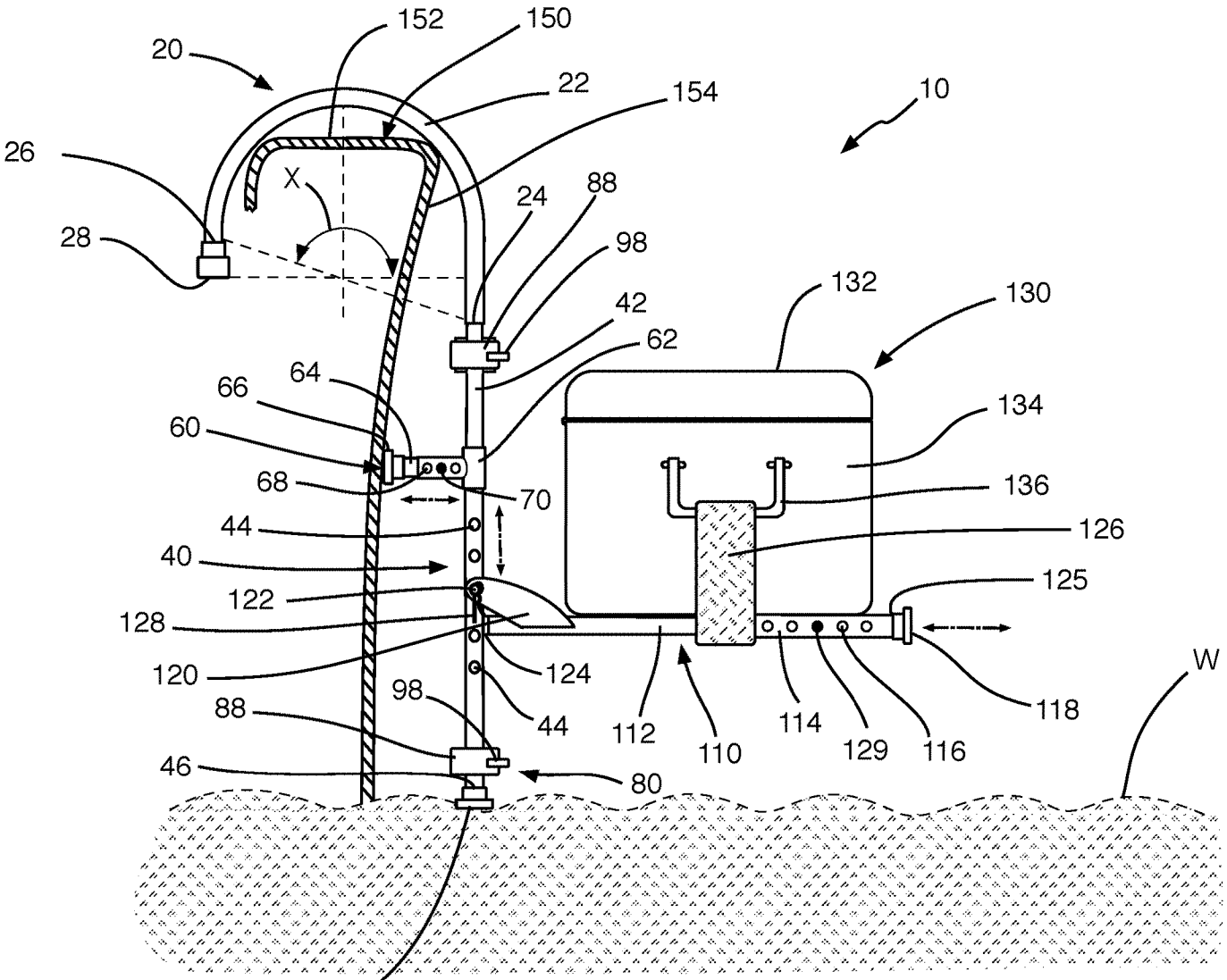
FIG. 2 is a side view of the present invention mounted onto the gunwale of a vessel that is partially represented, with a cooler secured thereto.

As seen in FIGS. 1 and 2, suspending arms 22 each comprise exterior end 24 and interior end 26. Interior end 26 has end cap 28 mounted thereon. When present invention 10 is mounted onto sea vessel 150, interior ends 26 are positioned within an interior perimeter of sea vessel 150, and specifically interior ends 26 are positioned at an interior side of gunwale 152. Suspending frame assembly 20 is configured as a rigid living spring for tension attachment onto gunwale 152. Vertical bars 42 each comprise bar end 46 and a plurality of holes 44. Vertical bars 42 are attached to a respective exterior end 24 of a respective suspending frame assembly 20. Each bar end 46 has cap 48 mounted thereon.

Each spacer frame assembly 60 is perpendicularly mounted to a respective vertical bar 42, and faces exterior surface 154. Spacer frame assembly 60 is adjustable and keeps present invention 10 spaced apart from exterior surface 154. Each spacer frame assembly 60 comprises a T-sleeve 62, an adjustable member 64, a spacer cap 66, spacer holes 68, and a push button 70. Each T-sleeve 62 is mounted on a respective vertical bar 42 at a predetermined distance from bar end 46. T-sleeve 62 and adjustable member 64 are configured for adjustment in a substantially perpendicular direction relative to respective vertical frame assembly 40.

Spacer holes 68 are aligned, adjusted, and fixed into position with push button 70, whereby push button 70 protrudes from a side of T-sleeve 62. Push button 70 comprises a ball detent locking system as is known. Adjustable member 64 is extended or retracted as desired and further secured into a fixed position including partial or full extension, or full retraction.

Present invention 10 provides an improvement over existing systems, as most boat hulls are not perpendicular to water W, but have a curvature. Spacer frame assembly 60 provides additional stability that until present invention 10 has not been realized.

Each telescopic bar assembly 80 comprises an exterior bar 82 having an exterior bar end 94, and an interior bar 84 having an interior bar end 92. Telescopic bar assemblies 80 each further comprises a plurality of adjusting holes 86, coupling members 88 and 90, locking buttons 96, and locks 98. In a preferred embodiment, interior bar end 92 has coupling member 88 attached to first vertical bar 42, and exterior bar end 94 has coupling member 90 attached to second vertical bar 42. Telescopic bar assembly 80 is configured such that interior bar 84 is selectively extended and retracted as desired and further secured into a fixed position including partial or full extension, or full retraction.

Supporting bar assemblies 110 each further comprise an extension bar 114, a plurality of bar holes 116, a proximal end 124, a distal end 125, and push buttons 129. Distal end 125 has bar cap 118 mounted thereto. Push buttons 129 comprise a ball detent locking system as is known.

Hinge arms 120 keep respective supporting bar assemblies 110 in an extended configuration, whereby first and second supporting bars 112 are secured substantially perpendicular to first and second vertical bars 42 respectively. When not in use, first and second supporting bar assemblies 110 may be in a retracted configuration, whereby first and second supporting bars 112 are positioned towards first and second vertical bars 42 respectively.

As seen in FIG. 2, suspending arms 22 comprise a substantially curved section formed between respective exterior ends 24 and interior ends 26 with a predetermined degree of curvature. Each suspending arm 22 is constructed with a degree of curvature X that is measured as a central angle as shown. In a preferred embodiment, X is between about 120 and 175 degrees. In another embodiment, X is between about 135 and 175 degrees. Although some systems include curved portions, they are typically curved at 180 degrees. The present invention has a significant improvement in performance when the angle degree of curvature is in the range described, as there is improved efficiency of configuration for the desired positioning on the outer perimeter of sea vessel 150.

Figure 3:
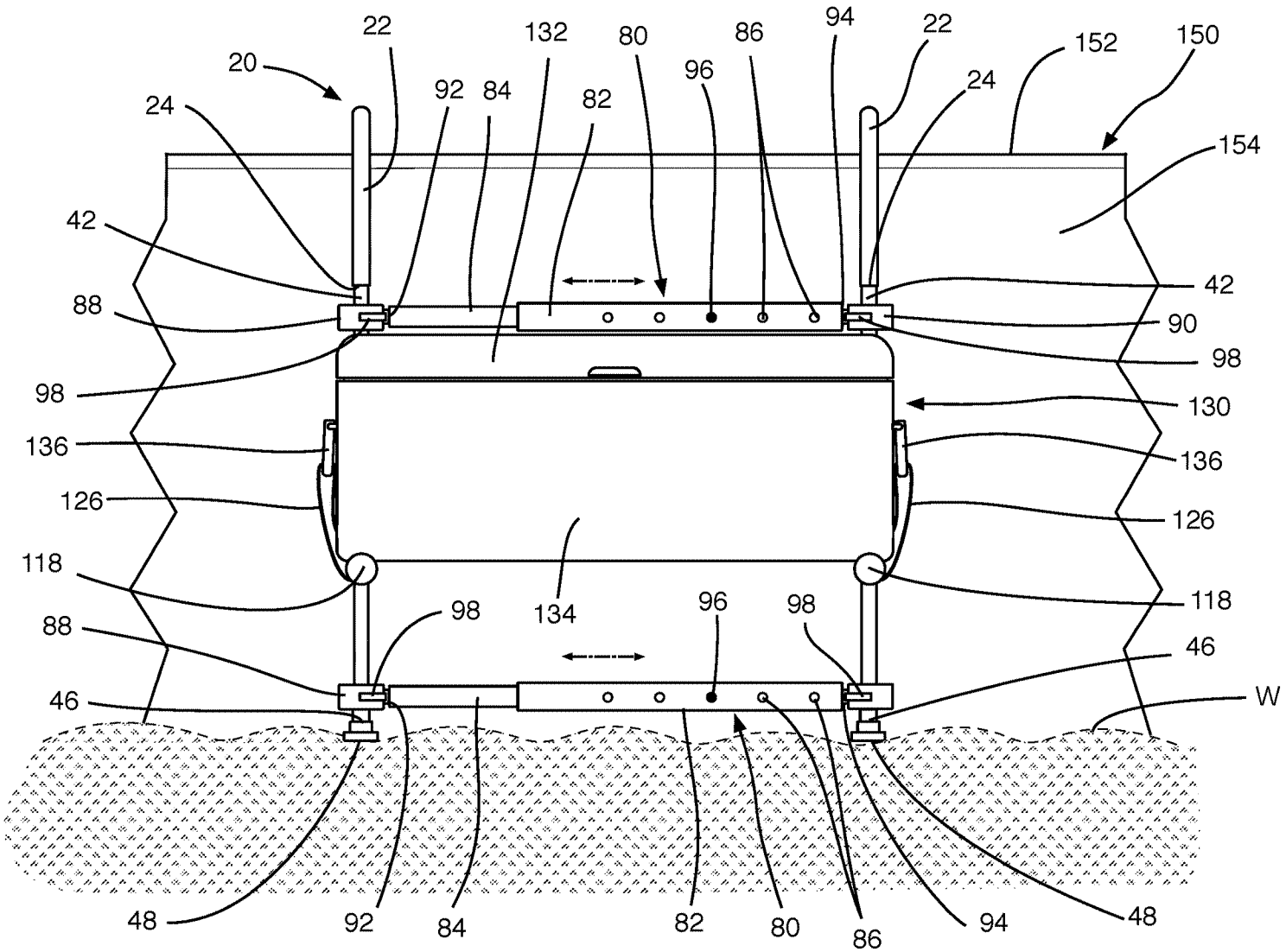
FIG. 3 is a front view of the present invention mounted onto the gunwale of a vessel that is partially represented, with a cooler secured thereto.

As seen in FIGS. 2 and 3, first and second supporting bar assemblies 110 are in an extended configuration and in a same plane to support cooler 130. Supporting bar assemblies 110 are constructed and arranged to support cooler 130, wherein cooler 130 is positioned onto first and second supporting bars 112 and first and second extension bars 114. Extension bar 114 may be extended or retracted as desired and further secured into a fixed position with push buttons 129 including partial or full extension, or full retraction. Supporting bar assemblies 110 each comprise strap 126 to secure cooler 130 onto respective supporting bars 112. Cooler 130 has lid 132, body 134 and handles 136. Specifically, straps 126 extend from supporting bar 112 and are attached to handles 136.

In use, present invention 10 is attached over an upper edge of gunwale 152 and extends along an outside perimeter of sea vessel 150. Suspended cooler frame assembly for sea vessels 10 may be adjusted in a way that water W does not reach cooler 130.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A suspended cooler frame assembly for sea vessels, comprising:

A) first and second suspending frame assemblies having respective first and second suspending arms each comprising an interior end and an exterior end, wherein said interior ends are positioned within an interior perimeter of said sea vessel when mounted on a gunwale, said first and second suspending arms comprise a substantially curved section formed between respective said exterior ends and said interior ends with a degree of curvature between 120 and 175 degrees;

B) first and second vertical frame assemblies having respective first and second vertical bars attached to said first and second suspending arms respectively;

C) first and second spacer frame assemblies perpendicularly mounted onto said first and second vertical frame assemblies respectively;

D) first and second telescopic bar assemblies attached to said first and second vertical frame assemblies; and E) first and second supporting bar assemblies having respective first and second supporting bars attached to said first and second vertical frame assemblies respectively, whereby said first and second suspending frame assemblies are suspended from said gunwale of a sea vessel.

2. The suspended cooler frame assembly for sea vessels set forth in claim 1, wherein said first and second vertical bars each comprise bar ends and a plurality of holes.

3. The suspended cooler frame assembly for sea vessels set forth in claim 1, wherein said first and second vertical bars are attached to said first and second exterior ends.

4. The suspended cooler frame assembly for sea vessels set forth in claim 2, wherein said first and second spacer frame assemblies each comprise a T-sleeve, an adjustable member, a spacer cap, spacer holes, and a push button, wherein each said T-sleeve is mounted on a respective of said first and second vertical bars at a predetermined distance from said bar ends, each said T-sleeve and each said adjustable member are configured for adjustment in a substantially perpendicular direction relative to said first and second vertical frame assemblies respectively.

5. The suspended cooler frame assembly for sea vessels set forth in claim 1, wherein said first and second telescopic bar assemblies each comprise an exterior bar having a respective exterior bar end, and an interior bar having a respective interior bar end.

6. The suspended cooler frame assembly for sea vessels set forth in claim 1, wherein said first and second telescopic bar assemblies each comprise a plurality of adjusting holes, coupling members having respective locks, and locking buttons.

7. The suspended cooler frame assembly for sea vessels set forth in claim 6, wherein said first and second telescopic bar assemblies are adjustably positioned between said first and second vertical bars and coupled thereto with respective said coupling members.

8. The suspended cooler frame assembly for sea vessels set forth in claim 1, wherein said first and second telescopic bar assemblies are positioned substantially parallel to each other, and substantially perpendicular to said first and second vertical bars.

9. The suspended cooler frame assembly for sea vessels set forth in claim 2, wherein said first and second supporting bar assemblies each comprise a pair of hinge arms, and each of said pair of hinge arms comprises a fastener pin and a lock pin.

10. The suspended cooler frame assembly for sea vessels set forth in claim 9, wherein each said pair of hinge arms extends from a respective said supporting bar and is secured at their respective said vertical bar with a respective said fastener pin and said lock pin.

11. The suspended cooler frame assembly for sea vessels set forth in claim 9, wherein one of said plurality of holes, of each said vertical bar, receives a respective said fastener pin to secure a respective said supporting bar at a desired height.

12. The suspended cooler frame assembly for sea vessels set forth in claim 9, wherein said supporting bars are positioned and secured perpendicularly to respective said vertical bars.

13. The suspended cooler frame assembly for sea vessels set forth in claim 1, wherein said first and second supporting bar assemblies each further comprises an extension bar, and a plurality of bar holes.

14. The suspended cooler frame assembly for sea vessels set forth in claim 1, wherein said first and second supporting bar assemblies are placed in a retracted configuration, whereby said first and second supporting bars are retracted toward said first and second vertical bars respectively.

15. The suspended cooler frame assembly for sea vessels set forth in claim 12, wherein said first and second supporting bar assemblies in an extended configuration are in a same plane arranged to support a cooler.

16. The suspended cooler frame assembly for sea vessels set forth in claim 15, wherein said first and second supporting bar assemblies are constructed and arranged to support said cooler wherein said cooler is positioned onto said first and second supporting bars.

17. The suspended cooler frame assembly for sea vessels set forth in claim 15, wherein said first and second supporting bar assemblies each comprise a strap to secure said cooler onto respective said first and second supporting bars.

* * * * *